US009870748B2

(12) United States Patent
Choi et al.

(10) Patent No.: US 9,870,748 B2
(45) Date of Patent: Jan. 16, 2018

(54) METHOD OF DRIVING A DISPLAY PANEL AND A DISPLAY APPARATUS FOR PERFORMING THE SAME

(71) Applicant: SAMSUNG DISPLAY CO., LTD., Yongin, Gyeonggi-Do (KR)

(72) Inventors: Hak-Mo Choi, Seoul (KR); Hoi-Sik Moon, Asan-si (KR); Gwang-Ho Nam, Asan-si (KR); Chang-Soo Lee, Suwon-si (KR); Min-Yup Chae, Cheonan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 85 days.

(21) Appl. No.: 14/740,652

(22) Filed: Jun. 16, 2015

(65) Prior Publication Data

US 2016/0189655 A1 Jun. 30, 2016

(30) Foreign Application Priority Data

Dec. 26, 2014 (KR) ..... 10-2014-0190908

(51) Int. Cl.
*G09G 3/36* (2006.01)

(52) U.S. Cl.
CPC ..... *G09G 3/3685* (2013.01); *G09G 3/3666* (2013.01); *G09G 3/3674* (2013.01); *G09G 3/3614* (2013.01); *G09G 2300/0413* (2013.01); *G09G 2310/0251* (2013.01); *G09G 2310/08* (2013.01); *G09G 2320/0223* (2013.01);
(Continued)

(58) Field of Classification Search
CPC ..... G09G 3/22; G09G 3/3208; G09G 3/30; G09G 3/3225; G09G 3/3233; G09G 3/3241; G09G 3/3266; G09G 3/3275; G09G 3/3258
See application file for complete search history.

(56) References Cited

U.S. PATENT DOCUMENTS 8,487,857 B2 * 7/2013 Kim ..... G09G 3/3614 345/209
9,324,290 B2 * 4/2016 Shin ..... G09G 3/3648
(Continued)

FOREIGN PATENT DOCUMENTS

KR 1020080010946 1/2008
KR 1020080075687 8/2008
KR 1020090066528 6/2009

*Primary Examiner* — Larry Sternbane
*Assistant Examiner* — William Lu
(74) *Attorney, Agent, or Firm* — F. Chau & Associates, LLC

(57) ABSTRACT

A method of driving a display panel is provided. The display panel includes first through n-th gate lines and a plurality of pixels each connected to one of the first through n-th gate lines (where n is a natural number). The method includes charging pixels connected to the n-th gate line with first data voltages corresponding to a first frame image during a first period, charging pixels connected to the first gate line with the first data voltages during the first period, charging the pixels connected to the first gate line with second data voltages corresponding to a second frame image during a second period subsequent to the first period, and charging pixels connected to the second gate line with the second data voltages during the second period.

20 Claims, 9 Drawing Sheets

(52) U.S. Cl.
CPC ..... *G09G 2320/0233* (2013.01); *G09G 2320/0252* (2013.01); *G09G 2320/0673* (2013.01)

(56) References Cited

U.S. PATENT DOCUMENTS

2002/0084965 A1* 7/2002 Park ..... G09G 3/3666 345/87
2002/0109652 A1* 8/2002 Lim ..... G09G 3/3648 345/87
2003/0020677 A1* 1/2003 Nakano ..... G09G 3/3413 345/87
2003/0197672 A1* 10/2003 Yun ..... G09G 3/3688 345/99
2006/0050563 A1* 3/2006 Lee ..... G09G 3/3648 365/185.22
2006/0061534 A1* 3/2006 Lee ..... G09G 3/3648 345/92
2006/0290859 A1* 12/2006 Ko ..... G02F 1/136286 349/139
2007/0069214 A1* 3/2007 Lee ..... G09G 3/3648 257/72
2008/0143659 A1* 6/2008 Ma ..... G09G 3/3677 345/87
2008/0180364 A1* 7/2008 Kim ..... G09G 3/3233 345/76
2008/0218502 A1* 9/2008 Lee ..... G09G 3/3674 345/208
2008/0266477 A1* 10/2008 Lee ..... G09G 3/3677 349/46
2008/0266505 A1* 10/2008 Yamamoto ..... G09G 3/3648 349/149
2009/0147164 A1* 6/2009 Toyoshima ..... G09G 3/3655 349/39
2009/0251404 A1* 10/2009 Hwang ..... G09G 3/344 345/107
2011/0007039 A1* 1/2011 Kim ..... G09G 3/293 345/204
2011/0292012 A1* 12/2011 Huang ..... G09G 3/3614 345/209
2013/0293526 A1* 11/2013 Igawa ..... G09G 3/3696 345/212
2014/0055503 A1* 2/2014 Jung ..... G09G 5/10 345/690
2015/0015564 A1* 1/2015 Yamagishi ..... G09G 3/3677 345/212

* cited by examiner

METHOD OF DRIVING A DISPLAY PANEL AND A DISPLAY APPARATUS FOR PERFORMING THE SAME

CROSS-REFERENCE TO RELATED PATENT APPLICATION

This application claims priority under 35 U.S.C. §119 to Korean Patent Application No. 10-2014-0190908, filed on Dec. 26, 2014, in the Korean Intellectual Property Office (KIPO), the disclosure of which is incorporated by reference herein in its entirety.

TECHNICAL FIELD

Exemplary embodiments of the present inventive concept relate to a display device, and more particularly, to a method of driving a display panel and a display apparatus for performing the method.

DISCUSSION OF THE RELATED ART

A display apparatus such as a liquid crystal display apparatus, or the like, includes a display panel and a driving circuit configured to drive the display panel.

If the display panel is driven by a single driving circuit, a charging rate for a pixel in the display panel may be degraded as a size and an operating speed of the display panel increase.

To increase the charging rate, the display panel may be divided into at least two panel portions to be driven by a plurality of driving circuits.

However, in this case, charging rates at the divided panel portions may differ from each other, which may be recognized by a viewer.

SUMMARY

According to an exemplary embodiment of the present inventive concept, a method of driving a display panel is provided. The display panel includes first through n-th gate lines and a plurality of pixels. Each of the plurality of pixels is connected to one of the first through n-th gate lines (where n is a natural number). The method includes charging pixels connected to the n-th gate line with first data voltages corresponding to a first frame image during a first period, charging pixels connected to the first gate line with the first data voltages during the first period, charging the pixels connected to the first gate line with second data voltages corresponding to a second frame image during a second period subsequent to the first period, and charging pixels connected to the second gate line with the second data voltages during the second period.

In an exemplary embodiment of the present inventive concept, the display panel may include a first area and a second area. A first gate driver and a first data driver may be connected to the first area. A second gate driver and a second data driver may be connected to the second area.

According to an exemplary embodiment of the present inventive concept, a method of driving a display panel is provided. The display panel includes first through n-th gate lines and a plurality of pixels. Each of the plurality of pixels is connected to one of the first through n-th gate lines (where n is a natural number). The method includes charging pixels connected to the n-th gate line with first data voltages corresponding to a first frame image during a first period, charging dummy capacitors connected to a dummy gate line in the display panel with second data voltages during a second period subsequent to the first period, charging pixels connected to the first gate line during the second period, and charging the pixels connected to the first gate line with third data voltages corresponding to a second frame image during a third period subsequent to the second period. Each of the first data voltages has a first polarity, each of the second data voltages has a second polarity different from the first polarity, and each of the third data voltages has the second polarity.

In an exemplary embodiment of the present inventive concept, the display panel may include a first area and a second area. A first gate driver and a first data driver may be connected to the first area. A second gate driver and a second data driver may be connected to the second area.

In an exemplary embodiment of the present inventive concept, the first area may include a first edge and a second edge. The second edge may be positioned at an opposite side to the first edge. The first area may be driven in a direction from the first edge to the second edge. The second area may include a third edge and a fourth edge. The fourth edge may be positioned at an opposite side to the third edge. The second area may be driven in a direction from the third edge to the fourth edge.

In an exemplary embodiment of the present inventive concept, one of the first edge or the second edge of the first area and one of the third edge or the fourth edge of the second area may be adjacent to a center of the display panel.

In an exemplary embodiment of the present inventive concept, the dummy gate line may be located adjacent to at least one of a first edge of the display panel or a second edge of the display panel. The second edge may be positioned at an opposite side to the first edge.

In an exemplary embodiment of the present inventive concept, a value of each of the second data voltages may be substantially the same as a value of a corresponding one of the third data voltages.

In an exemplary embodiment of the present inventive concept, the method may further include charging the dummy capacitors with the first data voltages during the first period.

According to an exemplary embodiment of the present inventive concept, a display apparatus is provided. The display apparatus includes a display panel, a gate driver, and a data driver. The display panel includes a plurality of pixels, a plurality of dummy capacitors, a plurality of data lines, a dummy gate line connected to the dummy capacitors, and first through n-th gate lines (where n is a natural number). The display panel is configured to display an image. The gate driver is configured to output an n-th gate voltage to the n-th gate line during a first period, configured to output a dummy gate voltage to the dummy gate line during a second period subsequent to the first period, configured to output a first charging gate voltage to the first gate line during the second period, and configured to output a first gate voltage to the first gate line during a third period subsequent to the second period. The data driver is configured to output first data voltages corresponding to a first frame image to the data lines during the first period, configured to output second data voltages to the data lines during the second period, and configured to output third data voltages corresponding to a second frame image to the data lines during the third period. Each of the first data voltages has a first polarity, each of the second data voltages has a second polarity different from the first polarity, and each of the third data voltages has the second polarity.

In an exemplary embodiment of the present inventive concept, the display panel may include a first area and a second area. The first area may be driven separately from the second area.

In an exemplary embodiment of the present inventive concept, the first area may include a first edge and a second edge. The second edge may be positioned at an opposite side to the first edge. The first area may be driven in a direction from the first edge to the second edge. The second area may include a third edge and a fourth edge. The fourth edge may be positioned at an opposite side to the third edge. The second area may be driven in a direction from the third edge to the fourth edge.

In an exemplary embodiment of the present inventive concept, one of the first edge or the second edge of the first area and one of the third edge or the fourth edge of the second area may be adjacent to a center of the display panel.

In an exemplary embodiment of the present inventive concept, the dummy gate line may be located adjacent to the first edge of the first area, the second edge of the first area, the third edge of the second area, or the fourth edge of the second area.

In an exemplary embodiment of the present inventive concept, the dummy gate line may be located adjacent to at least one of a first edge of the display panel or a second edge of the display panel. The second edge may be positioned at an opposite side to the first edge.

In an exemplary embodiment of the present inventive concept, a value of each of the second data voltages may be substantially the same as a value of a corresponding one of the third data voltages.

In an exemplary embodiment of the present inventive concept, the gate driver may be configured to output a dummy gate voltage to the dummy gate line during the first period.

In an exemplary embodiment of the present inventive concept, the display apparatus may further include a timing controller configured to generate signals for the data driver and the gate driver.

According to an exemplary embodiment of the present inventive concept, a display apparatus is provided. The display apparatus includes a display panel, a gate driver, and a data driver. The display panel includes a plurality of pixels, a plurality of data lines, and first through n-th gate lines (where n is a natural number). The display panel is configured to display an image. The gate driver is configured to output an (n−1)-th gate voltage to the (n−1)-th gate line during a first portion of a first period, to output a first charging gate voltage to the first gate line during the first portion of the first period, and to output a first gate voltage to the first gate line during a first portion of a second period subsequent to the first period. The data driver is configured to output first data voltages corresponding to a first frame image to the data lines during the first portion of the first period, and to output second data voltages corresponding to a second frame image to the data lines during the first portion of the second period.

In an exemplary embodiment of the present inventive concept, the gate driver may be configured to output an n-th gate voltage to the n-th gate line during a second portion of the first period, to output a second charging gate voltage to the second gate line during the second portion of the first period, and to output a second gate voltage to the second gate line during a second portion of the second period. The data driver may be configured to output third data voltages corresponding to the first frame image to the data lines during the second portion of the first period, and to output fourth data voltages corresponding to the second frame image to the data lines during the second portion of the second period. The second portion of the first period may be subsequent to the first portion of the first period, and the second portion of the second period may be subsequent to the first portion of the second period.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF EMBODIMENTS

Hereinafter, exemplary embodiments of the present inventive concept will be described in detail with reference to the accompanying drawings.

Figure 1:
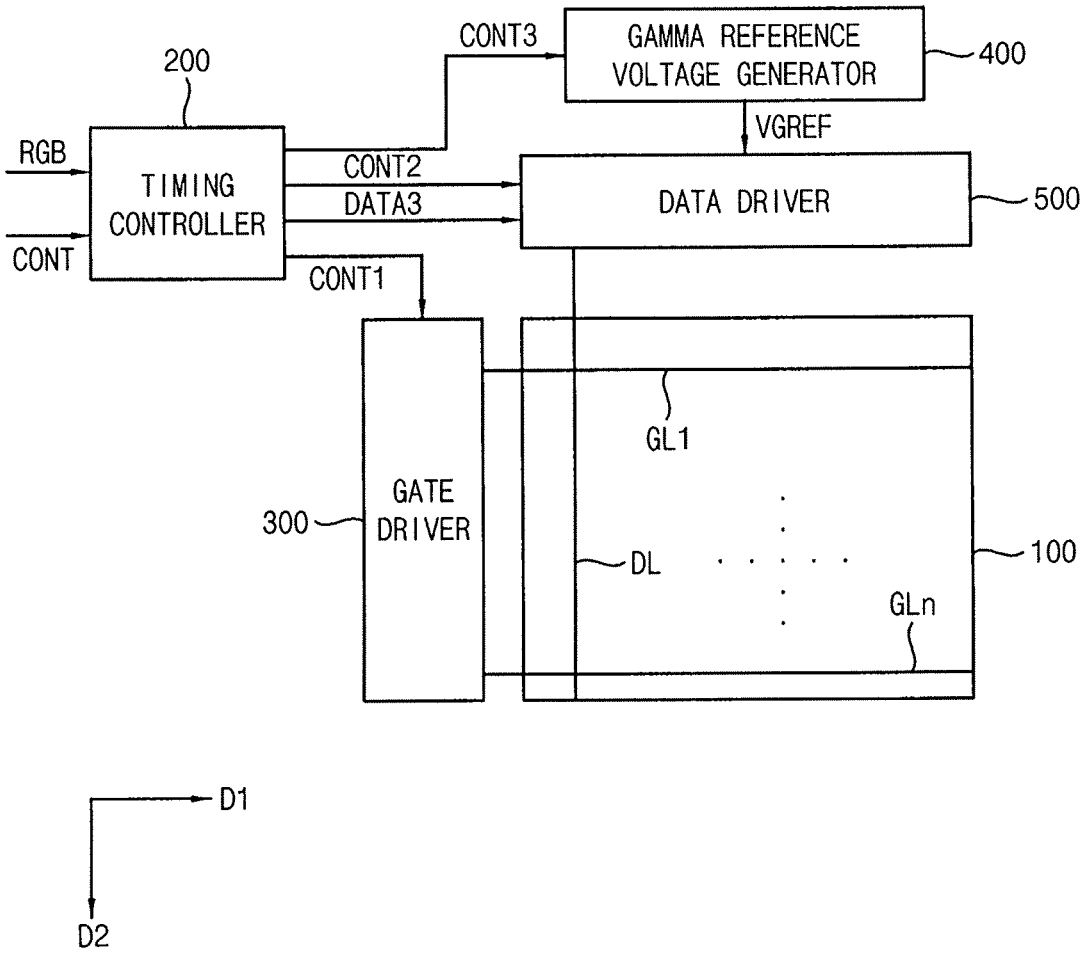
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 includes a display region for displaying an image and a peripheral region adjacent to the display region.

The display panel 100 includes a plurality of gate lines GL1~GLn, a plurality of data lines DL, and a plurality of pixels each connected to one of the gate lines GL1~GLn and one of the data lines DL. The gate lines GL1~GLn extend in a first direction D1 and the data lines DL extend in a second direction D2 crossing the first direction D1.

In an exemplary embodiment of the present inventive concept, each of the pixels includes a switching element, a liquid crystal capacitor, and a storage capacitor. The liquid crystal capacitor and the storage capacitor are electrically connected to the switching element. The pixels may be arranged in a matrix configuration.

The timing controller 200 receives input image data RGB and an input control signal CONT from an external device. The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL1~GLn in response to the first control signal CONT1 received from the timing controller 200. The gate driver 300 sequentially outputs the gate signals to the gate lines GL1~GLn.

In an exemplary embodiment of the present inventive concept, the gate driver 300 may be directly mounted on the display panel 100, or may be connected to the display panel 100 as a tape carrier package (TCP) type. In an exemplary embodiment of the present inventive concept, the gate driver 300 may be integrated on the peripheral region of the display panel 100.

The operations of the gate driver 300 and the data driver 500 will be described in detail with reference to FIGS. 2A and 2B.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. A level of the gamma reference voltage VGREF corresponds to a grayscale of pixel data included in the data signal DATA.

In an exemplary embodiment of the present inventive concept, the gamma reference voltage generator 400 may be disposed in the timing controller 200, or may be disposed in the data driver 500.

The data driver 500 receives the second control signal CONT2 and the data signal DATA from the timing controller 200, and receives the gamma reference voltage VGREF from the gamma reference voltage generator 400. The data driver 500 converts the data signal DATA to data voltages having analogue values based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a tape carrier package (TCP) type. In an exemplary embodiment of the present inventive concept, the data driver 500 may be integrated on the peripheral region of the display panel 100.

In an exemplary embodiment of the present inventive concept, the display panel 100 may include a first area and a second area, the gate driver 300 may include a first gate driver and a second gate driver, and the data driver 500 may include a first data driver and a second data driver. The first gate driver and the first data driver may drive the first area of the display panel 100, the second gate driver and the second data driver may drive the second area of the display panel 100.

The operations of the gate driver 300 and the data driver 500 will be described in detail with reference to FIGS. 2A and 2B.

Figure 2A:
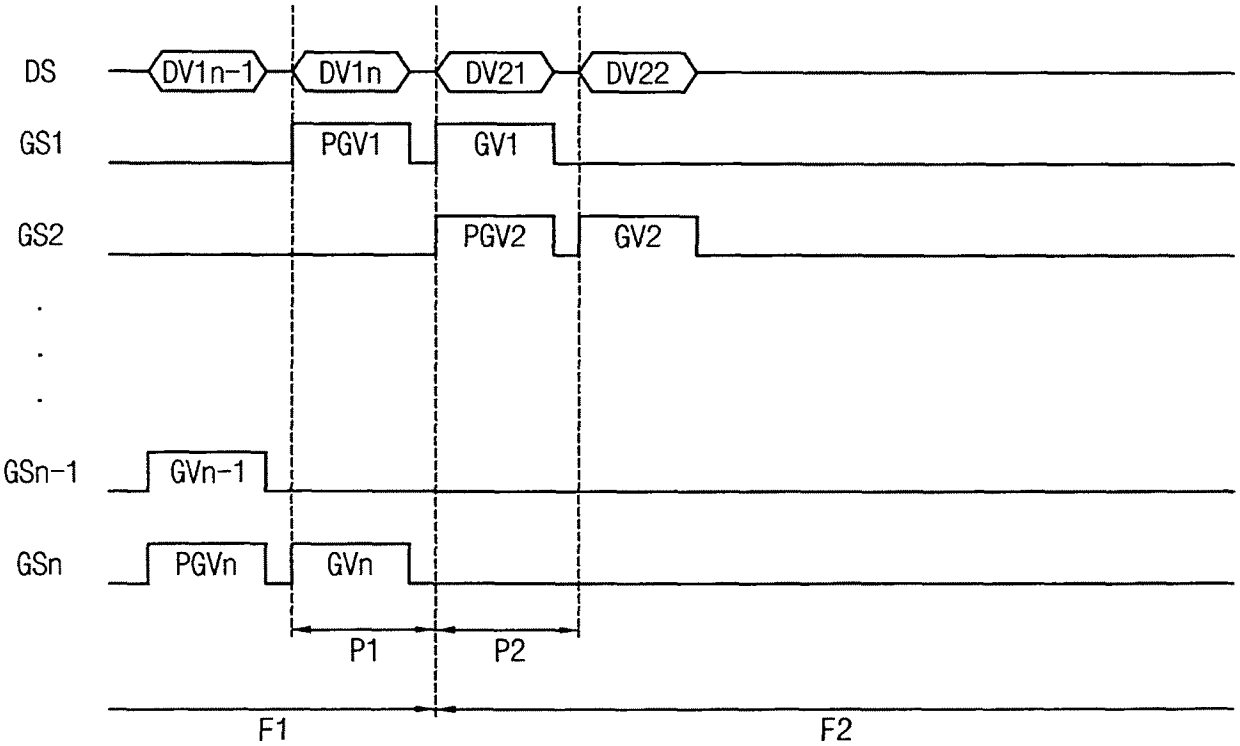
FIG. 2A is a timing diagram illustrating data signals and gate signals according to an exemplary embodiment of the present inventive concept.

FIG. 2A is a timing diagram illustrating data signals and gate signals according to an exemplary embodiment of the present inventive concept.

Referring to FIGS. 1 and 2A, the gate driver 300 generates gate signals GS1~GSn for driving the gate lines GL1~GLn, respectively, in response to the first control signal CONT1 received from the timing controller 200. The gate driver 300 sequentially outputs the gate signals GS1~GSn to the gate lines GL1~GLn, respectively.

The gate driver 300 sequentially outputs a first gate signal GS1 through an n-th gate signal GSn (where n is a natural number) to a first gate line GL1 through an n-th gate line GLn, respectively, during a first frame F1. The gate driver 300 sequentially outputs the first gate signal GS1 through the n-th gate signal GSn to the first gate line GL1 through the n-th gate line GLn, respectively, during a second frame F2 which, e.g., follows the first frame.

The gate driver 300 outputs an n-th gate voltage GVn to the n-th gate line GLn during a first period P1. For example, the first period P1 may be in the first frame F1. The gate driver 300 outputs a first preliminary charging gate voltage PGV1 to the first gate line GL1 during the first period P1. Pixels connected to the n-th gate line GLn are charged during the first period P1, and pixels connected to the first gate line GL1 are preliminarily charged during the first period P1.

The gate driver 300 outputs a first gate voltage GV1 to the first gate line GL1 during a second period P2. For example, the second period P2 may be in the second frame F2. The gate driver 300 outputs a second preliminary charging gate voltage PGV2 to the second gate line GL2 during the second period P2. The pixels connected to the first gate line GL1 are charged during the second period P2, and pixels connected to the second gate line GL2 are preliminarily charged during the second period P2.

The data driver 500 outputs data voltages DV11~DV1*n* corresponding to the first frame F1 during the first frame F1. For example, the data driver 500 outputs the data voltages DV1*n* corresponding to the n-th gate line GLn during the first period P1.

The data driver 500 outputs data voltages DV21~DV2*n* corresponding to the second frame F2 during the second frame F2. For example, the data driver 500 outputs the data voltages DV21 corresponding to the first gate line GL1 during the second period P2.

For example, pixels connected to the first gate line GL1 may be preliminarily charged with data voltages DV1*n* corresponding to pixels connected to the n-th gate line GLn during the first period P1.

According to the method of the preliminary charging, pixels connected to a k-th gate line (where k is a natural number equal to or greater than one and equal to or smaller than n) may be preliminarily charged with data voltages corresponding to pixels connected to a (k−1)-th gate line.

Figure 2B:
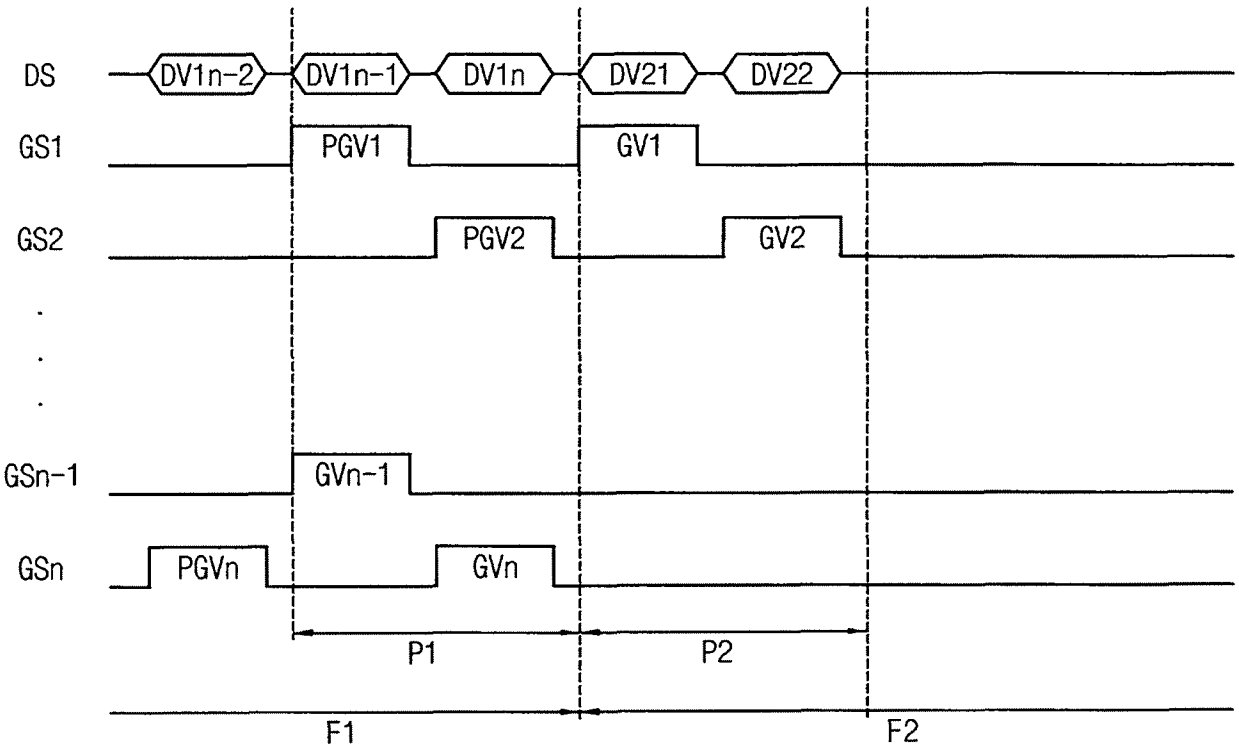
FIG. 2B is a timing diagram illustrating data signals and gate signals according to an exemplary embodiment of the present inventive concept.

FIG. 2B is a timing diagram illustrating data signals and gate signals according to an exemplary embodiment of the present inventive concept.

Referring to FIGS. 1 and 2B, the gate driver 300 generates gate signals GS1~GSn for driving the gate lines GL1~GLn, respectively, in response to the first control signal CONT1 received from the timing controller 200. The gate driver 300 sequentially outputs the gate signals GS1~GSn to the gate lines GL1~GLn, respectively.

The gate driver 300 sequentially outputs a first gate signal GS1 through an n-th gate signal GSn to a first gate line GL1 through an n-th gate line GLn, respectively, during a first frame F1. The gate driver 300 sequentially outputs the first gate signal GS1 through the n-th gate signal GSn to the first gate line GL1 through the n-th gate line GLn, respectively, during a second frame F2 which, e.g., follows the first frame.

The gate driver 300 outputs an (n−1)-th gate voltage GVn−1 to an (n−1)-th gate line GLn−1 during a first half of a first period P1. For example, the first period P1 may be in the first frame F1. The gate driver 300 outputs a first preliminary charging gate voltage PGV1 to the first gate line GL1 during the first half of the first period P1. Pixels connected to the first gate line GL1 are preliminarily charged during the first half of the first period P1. The gate driver 300 outputs an n-th gate voltage GVn to the n-th gate line GLn during a second half of the first period. The gate driver 300 outputs a second preliminary charging gate voltage PGV2 to the second gate line GL2 during the second half of the first period P1. Pixels connected to the second gate line GL2 are preliminarily charged during the second half of the first period P1.

The gate driver 300 outputs a first gate voltage GV1 to the first gate line GL1 during a first half of a second period P2. For example, the second period P2 may be in the second frame F2. The gate driver 300 outputs a second gate voltage GV2 to the second gate line GL2 during a second half of the second period P2.

The data driver 500 outputs data voltages DV11~DV1*n* corresponding to the first frame F1 during the first frame F1. For example, the data driver 500 outputs the data voltages DV1*n*−1 corresponding to the (n−1)-th gate line GLn−1 during the first half of the first period P1. The data driver 500 outputs the data voltages DV1*n* corresponding to the n-th gate line GLn during the second half of the first period P1.

The data driver 500 outputs data voltages DV21~DV2*n* corresponding to the second frame F2 during the second frame F2. For example, the data driver 500 outputs the data voltages DV21 corresponding to the first gate line GL1 during the first half of the second period P2. The data driver 500 outputs the data voltages DV22 corresponding to the second gate line GL2 during the second half of the second period P2.

For example, pixels connected to the second gate line GL2 may be preliminarily charged with data voltages DV1*n* corresponding to pixels connected to the n-th gate line GLn during the second half of the first period P1.

According to the method of the preliminary charging, pixels connected to a k-th gate line may be preliminarily charged with data voltages corresponding to pixels connected to a (k−2)-th gate line.

According to an exemplary embodiment of the present inventive concept, pixels connected to the (n−1)-th gate line GLn−1 or the n-th gate line GLn corresponding to the first frame F1 are charged during the first period P1. Pixels connected to the first gate line GL1 or the second gate line GL2 corresponding to the second frame F2 are preliminarily charged during the first period. For example, a blank period may not be present between the first frame F1 and the second frame F2. For example, the blank period may be understood as a period in which a pixel is not charged with a data voltage.

Figure 3:
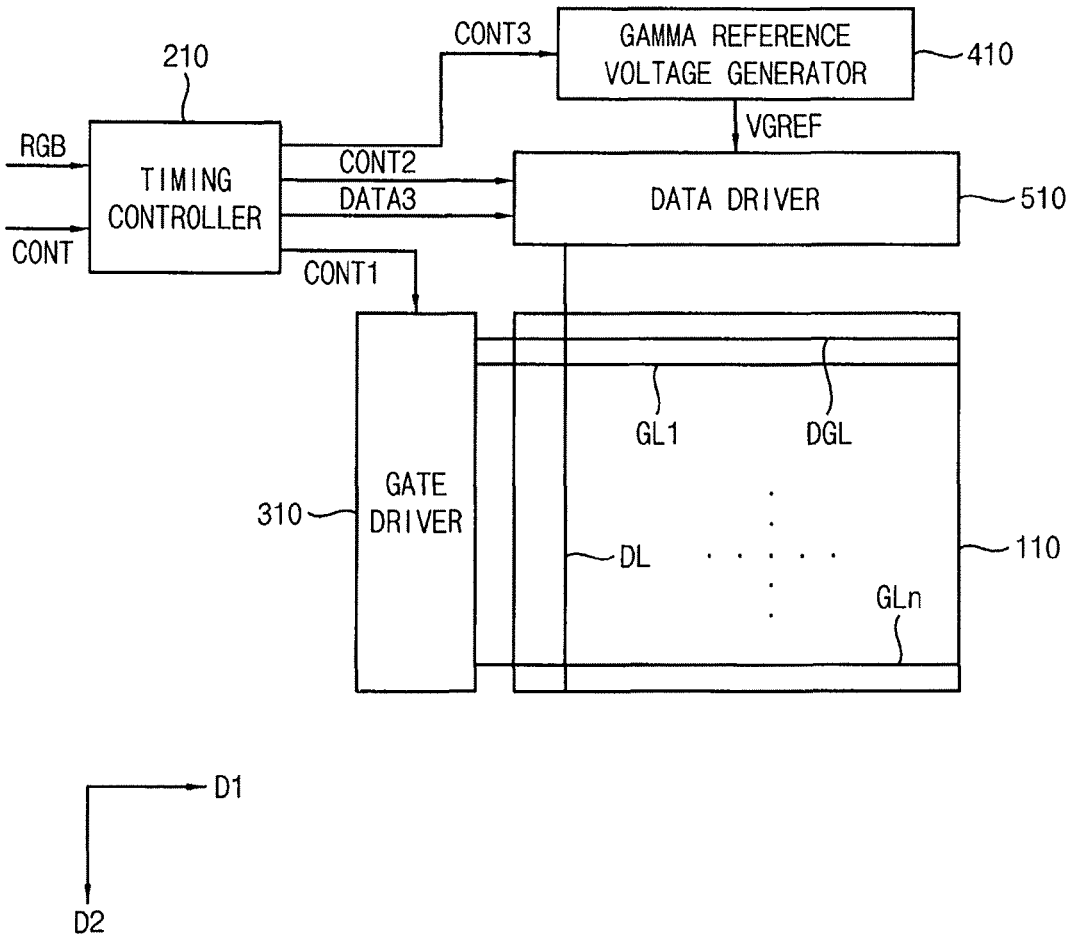
FIG. 3 is a block diagram illustrating a display apparatus according to an exemplary embodiment of the present inventive concept.

FIG. 3 is a block diagram illustrating a display apparatus according to an exemplary embodiment of the present inventive concept.

Referring to FIG. 3, the display apparatus includes a display panel 110 and a panel driver. The panel driver includes a timing controller 210, a gate driver 310, a gamma reference voltage generator 410, and a data driver 510.

The display panel 110 includes a display region for displaying an image and a peripheral region adjacent to the display region.

The display panel 110 includes a plurality of gate lines GL1~GLn, a plurality of data lines DL, a dummy gate line DGL, a plurality of pixels each connected to one of the gate lines GL1~GLn and one of the data lines DL, and dummy capacitors connected to the dummy gate line DGL. The gate lines GL1~GLn and the dummy gate line DGL extend in a first direction D1, and the data lines DL extend in a second direction D2 crossing the first direction D1.

In an exemplary embodiment of the present inventive concept, each of the pixels includes a switching element, a liquid crystal capacitor, and a storage capacitor. The liquid crystal capacitor and the storage capacitor are electrically connected to the switching element. The pixels may be arranged in a matrix configuration.

The timing controller 210 receives input image data RGB and an input control signal CONT from an external device. The input image data RGB may include red image data R, green image data G, and blue image data B. The input control signal CONT may include a master clock signal and a data enable signal. The input control signal CONT may further include a vertical synchronizing signal and a horizontal synchronizing signal.

The timing controller 210 generates a first control signal CONT1, a second control signal CONT2, a third control signal CONT3, and a data signal DATA based on the input image data RGB and the input control signal CONT.

The timing controller 210 generates the first control signal CONT1 for controlling operations of the gate driver 310 based on the input control signal CONT, and outputs the first control signal CONT1 to the gate driver 310. The first control signal CONT1 may include a vertical start signal and a gate clock signal.

The timing controller 210 generates the second control signal CONT2 for controlling operations of the data driver 510 based on the input control signal CONT, and outputs the second control signal CONT2 to the data driver 510. The second control signal CONT2 may include a horizontal start signal and a load signal.

The timing controller 210 generates the data signal DATA based on the input image data RGB. The timing controller 210 outputs the data signal DATA to the data driver 510.

The timing controller 210 generates the third control signal CONT3 for controlling operations of the gamma reference voltage generator 410 based on the input control signal CONT, and outputs the third control signal CONT3 to the gamma reference voltage generator 410.

The gate driver 310 generates gate signals for driving the gate lines GL1~GLn and the dummy gate line DGL in response to the first control signal CONT1 received from the timing controller 210. The gate driver 310 sequentially outputs the gate signals to the dummy gate line DGL and the gate lines GL1~GLn.

In an exemplary embodiment of the present inventive concept, the gate driver 310 may be directly mounted on the display panel 110, or may be connected to the display panel 110 as a tape carrier package (TCP) type. In an exemplary embodiment of the present inventive concept, the gate driver 310 may be integrated on the peripheral region of the display panel 110.

The operations of the gate driver 310 and the data driver 510 will be described in detail with reference to FIGS. 4A and 4B.

The gamma reference voltage generator 410 generates a gamma reference voltage VGREF in response to the third control signal CONT3 received from the timing controller 210. The gamma reference voltage generator 410 outputs the gamma reference voltage VGREF to the data driver 510. A level of the gamma reference voltage VGREF corresponds to a grayscale of pixel data included in the data signal DATA.

In an exemplary embodiment of the present inventive concept, the gamma reference voltage generator 410 may be disposed in the timing controller 210, or may be disposed in the data driver 510.

The data driver 510 receives the second control signal CONT2 and the data signal DATA from the timing controller 210, and receives the gamma reference voltage VGREF from the gamma reference voltage generator 410. The data driver 510 converts the data signal DATA to data voltages having analogue values based on the gamma reference voltage VGREF. The data driver 510 outputs the data voltages to the data lines DL.

The data driver 510 alternates polarities of data voltages frame by frame. For example, the data driver 510 may output data voltages each of which has a first polarity during a first frame, and may output data voltages each of which has a second polarity during a second frame which, e.g., follows the first frame. In an exemplary embodiment of the present inventive concept, the data driver 510 may output data voltages each of which has the second polarity during the first frame, and may output data voltages each of which has the first polarity during the second frame.

Hereinafter, a method of driving a display apparatus according to an exemplary embodiment of the present inventive concept will be described in detail with reference to FIGS. 5A and 5B.

In an exemplary embodiment of the present inventive concept, the data driver 510 may be directly mounted on the display panel 110, or may be connected to the display panel 110 as a tape carrier package (TCP) type. In an exemplary embodiment of the present inventive concept, the data driver 510 may be integrated on the peripheral region of the display panel 110.

The operations of the gate driver 310 and the data driver 510 will be described in detail with reference to FIGS. 4A and 4B.

Figure 4A:
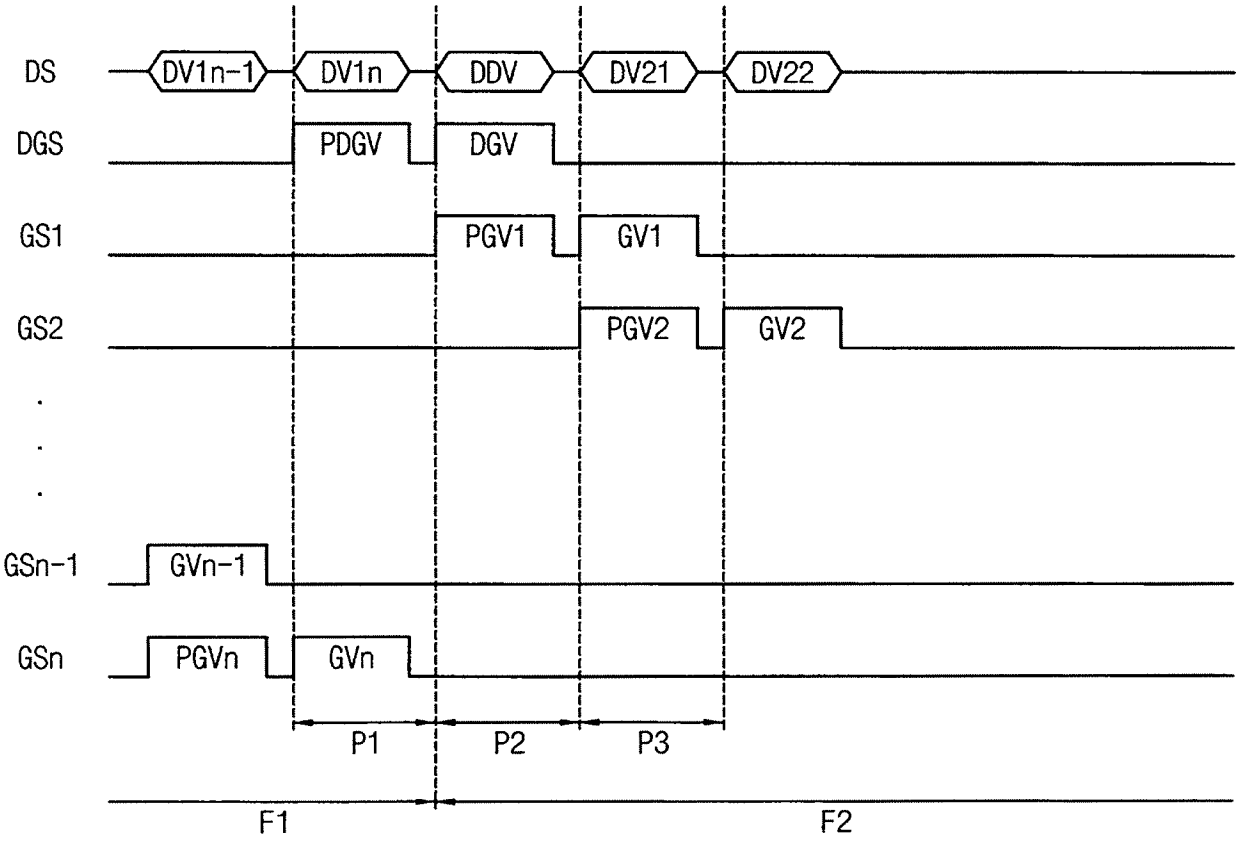
FIG. 4A is a timing diagram illustrating data signals and gate signals according to an exemplary embodiment of the present inventive concept.

FIG. 4A is a timing diagram illustrating data signals and gate signals according to an exemplary embodiment of the present inventive concept.

Referring to FIGS. 3 and 4A, the gate driver 310 generates a dummy gate signal DGS and gate signals GS1~GSn for driving the dummy gate line DGL and the gate lines GL1~GLn, respectively, in response to the first control signal CONT1 received from the timing controller 210. The gate driver 310 sequentially outputs the dummy gate signal DGS and the gate signals GS1~GSn to the dummy gate line DGL and the gate lines GL1~GLn, respectively.

The gate driver 310 sequentially outputs a dummy gate signal DGS and a first gate signal GS1 through an n-th gate signal GSn (where n is a natural number) to a dummy gate line DGL and a first gate line GL1 through an n-th gate line GSn, respectively, during a first frame F1. The gate driver 310 sequentially outputs the dummy gate signal DGS and the first gate signal GS1 through the n-th gate signal GSn to the dummy gate line DGL and the first gate line GL1 through the n-th gate line GSn, respectively, during a second frame F2 which, e.g., may follow the first frame F1.

The gate driver 310 outputs an n-th gate voltage GVn to the n-th gate line GLn during a first period P1. For example, the first period P1 may be in the first frame F1. The gate driver 310 may output a preliminary charging dummy gate voltage PDGV to the dummy gate line DGL during the first period P1. In this case, the dummy capacitors connected to the dummy gate line DGL may be charged during the first period P1.

The gate driver 310 outputs a dummy gate voltage DGV to the dummy gate line DGL during a second period P2. For example, the second period P2 may be in the second frame F2. The gate driver 310 outputs a first preliminary charging gate voltage PGV1 to the first gate line GL1 during the second period P2. Pixels connected to the first gate line GL1 are preliminarily charged during the second period P2.

The gate driver 310 outputs a first gate voltage GV1 to the first gate line GL1 during a third period P3. For example, the third period P3 may follow the second period P2 and may be in the second frame F2. The gate driver 310 outputs a second preliminary charging gate voltage PGV2 to the second gate line GL2 during the third period P3. Pixels connected to the second gate line GL2 are preliminarily charged during the third period P3.

The data driver 510 outputs data voltages DV11~DV1*n* corresponding to the first frame F1 during the first frame F1. For example, the data driver 510 outputs the data voltages DV1*n* corresponding to the n-th gate line GLn during the first period P1.

The data driver 510 outputs dummy data voltages DDV and data voltages DV21~DV2*n* corresponding to the second frame F2 during the second frame F2. For example, the data driver 510 outputs the dummy data voltages DDV during the second period P2 of the second frame F2. The data driver 510 outputs the data voltages DV21 corresponding to the first gate line GL1 during the third period P3 of the second frame F2.

A value of each of the dummy data voltages DDV may be substantially the same as a value of each of the data voltages DV21 corresponding to the first gate line GL1 of the second frame F2.

A polarity of each of the data voltages DV11~DV1*n* output during the first frame F1 is opposite to a polarity of each of the data voltages DV21~DV2*n* output during the second frame F2. For example, the data driver 510 may output data voltages each of which has the first polarity during the first frame F1, and may output data voltages each of which has the second polarity during the second frame F2. In an exemplary embodiment of the present inventive concept, the data driver 510 may output data voltages each of which has the second polarity during the first frame F1, and may output data voltages each of which has the first polarity during the second frame F2.

For example, pixels connected to the second gate line GL2 may be preliminarily charged with data voltages DV21 corresponding to pixels connected to the first gate line GL1 during the third period P1.

According to the method of the preliminary charging, pixels connected to a k-th gate line (where k is a natural number equal to or greater than one and equal to or smaller than n) are preliminarily charged with data voltages corresponding to pixels connected to a (k−1)-th gate line.

Figure 4B:
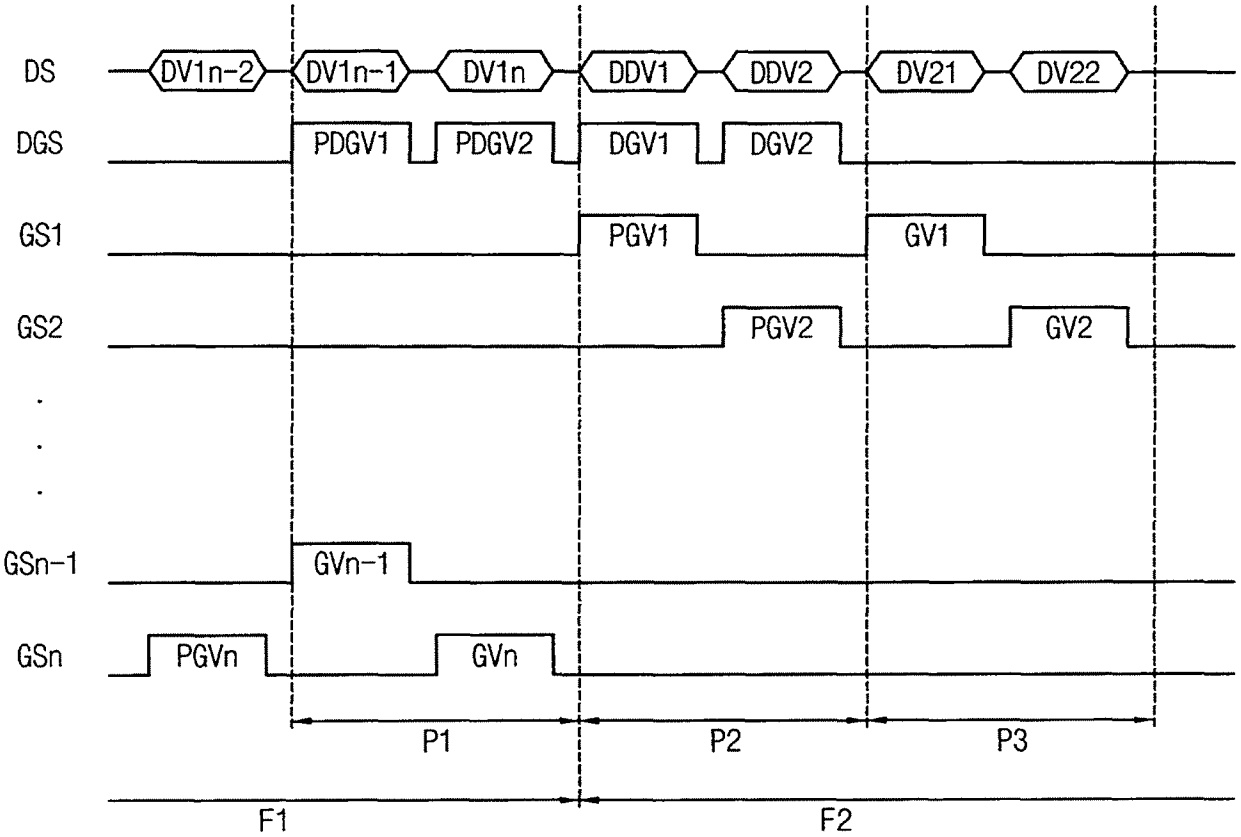
FIG. 4B is a timing diagram illustrating data signals and gate signals according to an exemplary embodiment of the present inventive concept.

FIG. 4B is a timing diagram illustrating data signals and gate signals according to an exemplary embodiment of the present inventive concept.

Referring to FIGS. 3 and 4B, the gate driver 310 generates a dummy gate signal DGS and gate signals GS1~GSn for driving the dummy gate line DGL and the gate lines GL1~GLn, respectively, in response to the first control signal CONT1 received from the timing controller 210. The gate driver 310 sequentially outputs the dummy gate signal DGS and gate signals GS1~GSn to the dummy gate line DGL and the gate lines GL1~GLn, respectively.

The gate driver 310 sequentially outputs a dummy gate signal DGS and a first gate signal GS1 through an n-th gate signal GSn to a dummy gate line DGL and a first gate line GL1 through an n-th gate line GSn, respectively, during a first frame F1. The gate driver 310 sequentially outputs the dummy gate signal DGS and the first gate signal GS1 through the n-th gate signal GSn to the dummy gate line DGL and the first gate line GL1 through the n-th gate line GSn, respectively, during a second frame F2 which, e.g., follows the first frame F1.

The gate driver 310 outputs an (n−1)-th gate voltage GVn−1 to the (n−1)-th gate line GLn−1 during a first half of a first period P1. For example, the first period P1 may be in a first frame F1. The gate driver 310 may output a first preliminary charging dummy gate voltage PDGV1 to the dummy gate line DGL during the first half of the first period P1. In this case, the dummy capacitors connected to the dummy gate line DGL may be charged during the first half of the first period P1.

The gate driver 310 outputs an n-th gate voltage GVn to the n-th gate line GLn during a second half of the first period P1. The gate driver 310 may output a second preliminary charging dummy gate voltage PDGV2 to the dummy gate line DGL during the second half of the first period P1. In this case, the dummy capacitors connected to the dummy gate line DGL may be charged during the second half of the first period P1.

The gate driver 310 outputs a first dummy gate voltage DGV1 to the dummy gate line DGL during a first half of a second period P2. For example, the second period P2 may be in the second frame F2. The gate driver 310 outputs a first preliminary charging gate voltage PGV1 to the first gate line GL1 during the first half of the second period P2. Pixels connected to the first gate line GL1 are preliminarily charged during the first half of the second period P2.

The gate driver 310 outputs a second dummy gate voltage DGV2 to the dummy gate line DGL during a second half of the second period P2. The gate driver 310 outputs a second preliminary charging gate voltage PGV2 to the second gate line GL2 during the second half of the second period P2. Pixels connected to the second gate line GL2 are preliminarily charged during the second half of the second period P2.

The gate driver 310 outputs a first gate voltage GV1 to the first gate line GL1 during a first half of a third period P3. For example, the third period P3 may follow the second period P2 and may be in the second frame F2. The gate driver 310 outputs a second gate voltage GV2 to the second gate line GL2 during a second half of the third period P3.

The data driver 510 outputs data voltages DV11~DV1*n* corresponding to the first frame F1 during the first frame F1. For example, the data driver 510 outputs the data voltages DV1*n*−1 corresponding to the (n−1)-th gate line GLn−1 during the first half of the first period P1. The data driver 510 outputs the data voltages DV1*n* corresponding to the n-th gate line GLn during the second half of the first period P1.

The data driver 510 outputs first dummy data voltages DDV1, second dummy data voltages DDV2, and data voltages DV21~DV2*n* during the second frame F2. For example, the data driver 510 outputs the first dummy data voltages DDV1 during the first half of the second period P2. The data driver 510 outputs the second dummy data voltages DDV2 during the second half of the second period P2. The data driver 510 outputs the data voltages DV21 corresponding to the first gate line GL1 during the first half of the third period P3. The data driver 510 outputs the data voltages DV22 corresponding to the second gate line GL2 during the second half of the third period P3.

A value of each of the first dummy data voltages DDV1 may be substantially the same as a value of each of the data voltages DV21 corresponding to the first gate line GL1 of the second frame F2. A value of each of the second dummy data voltages DDV2 may be substantially the same as a value of each of the data voltages DV22 corresponding to the second gate line GL2 of the second frame F2.

A polarity of each of the data voltages DV11~DV1*n* output during the first frame F1 is opposite to a polarity of each of the data voltages DV21~DV2*n* output during the second frame F2. For example, the data driver 510 may output data voltages each of which has the first polarity during the first frame F1, and may output data voltages each of which has the second polarity during the second frame F2. In an exemplary embodiment of the present inventive concept, the data driver 510 may output data voltages each of which has the second polarity during the first frame F1, and may output data voltages each of which has the first polarity during the second frame F2.

For example, pixels connected to the second gate line GL2 may be preliminarily charged with the second dummy data voltages DDV2 corresponding to the dummy gate line DGL.

According to the method of the preliminary charging, pixels connected to a k-th gate line may be preliminarily charged with data voltages corresponding to pixels connected to a (k−2)-th gate line.

According to an exemplary embodiment of the present inventive concept, when a polarity of a data voltage corresponding to a pixel during a first frame F1 is opposite to a polarity of a data voltage corresponding to the pixel during a second frame F2, a dummy gate line DGL may be disposed between an n-th gate line of the first frame F1 and a first gate line of the second frame F2. Therefore, during the second frame F2, a polarity of each of preliminary charging data voltages applied to the first gate line GL1 may be same as a polarity of each of main charging data voltages applied to the first gate GL1, and a polarity of each of preliminary charging data voltages applied to the second gate line GL2 may be same as a polarity of each of main charging data voltages applied to the second gate GL2.

Figure 5A:
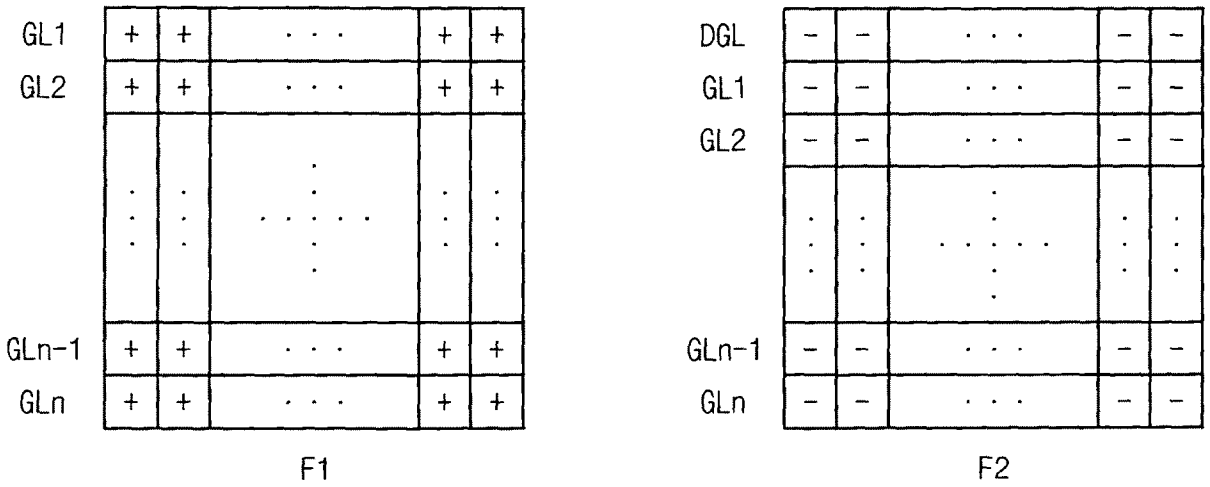
FIG. 5A is a diagram illustrating polarities of pixels when a dummy gate line is located adjacent to a first edge of a display panel in FIG. 3 according to an exemplary embodiment of the present inventive concept.

FIG. 5A is a diagram illustrating polarities of pixels when a dummy gate line DGL is located adjacent to a first edge of a display panel 110 in FIG. 3 according to an exemplary embodiment of the present inventive concept.

Referring to FIGS. 3, 4A, and 5A, the dummy gate line DGL is located adjacent to a first edge of the display panel 110. The first edge is substantially parallel to the first gate line GL1 and is the nearest edge from the first gate line GL1.

The data driver 510 outputs data voltages DV11~DV1*n* each of which has a first polarity (e.g., a positive polarity "+") during the first frame F1. The data driver 510 outputs data voltages DDV, DV21~DV2*n* each of which has a second polarity (e.g., a negative polarity "−") during the second frame F2. For example, the data driver 510 outputs data voltages DDV each of which has the second polarity to dummy capacitors connected to the dummy gate line DGL during the second frame F2. The data driver 510 outputs data voltages DV21 each of which has the second polarity to pixels connected to the first gate line GL1 during the second frame F2.

Figure 5B:
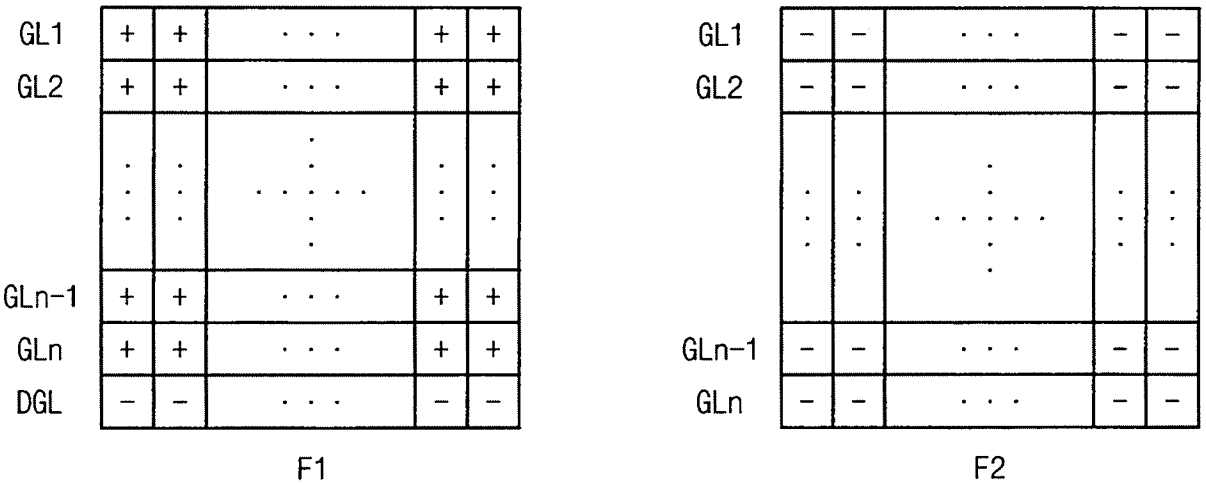
FIG. 5B is a diagram illustrating polarities of pixels when a dummy gate line is located adjacent to a second edge of a display panel in FIG. 3 according to an exemplary embodiment of the present inventive concept.

FIG. 5B is a diagram illustrating polarities of pixels when a dummy gate line DGL is located adjacent to a second edge of a display panel 110 in FIG. 3 according to an exemplary embodiment of the present inventive concept.

Referring to FIGS. 3, 4A, and 5B, the dummy gate line DGL is located adjacent to a second edge of the display panel 110. The second edge is substantially parallel to the n-th gate line GLn and is the nearest edge from the n-th gate line GLn.

The data driver 510 outputs data voltages DV11~DV1*n* each of which has a first polarity (e.g., a positive polarity "+") to pixels connected to the first gate line GL1 through the n-th gate line GLn during the first frame F1. The data driver 510 outputs data voltages DDV each of which has a second polarity (e.g., a negative polarity "−") to dummy capacitors connected to the dummy gate line DGL during the first frame F1. The data driver 510 outputs data voltages DV21~DV2*n* each of which has the second polarity during the second frame F2.

Figure 6:
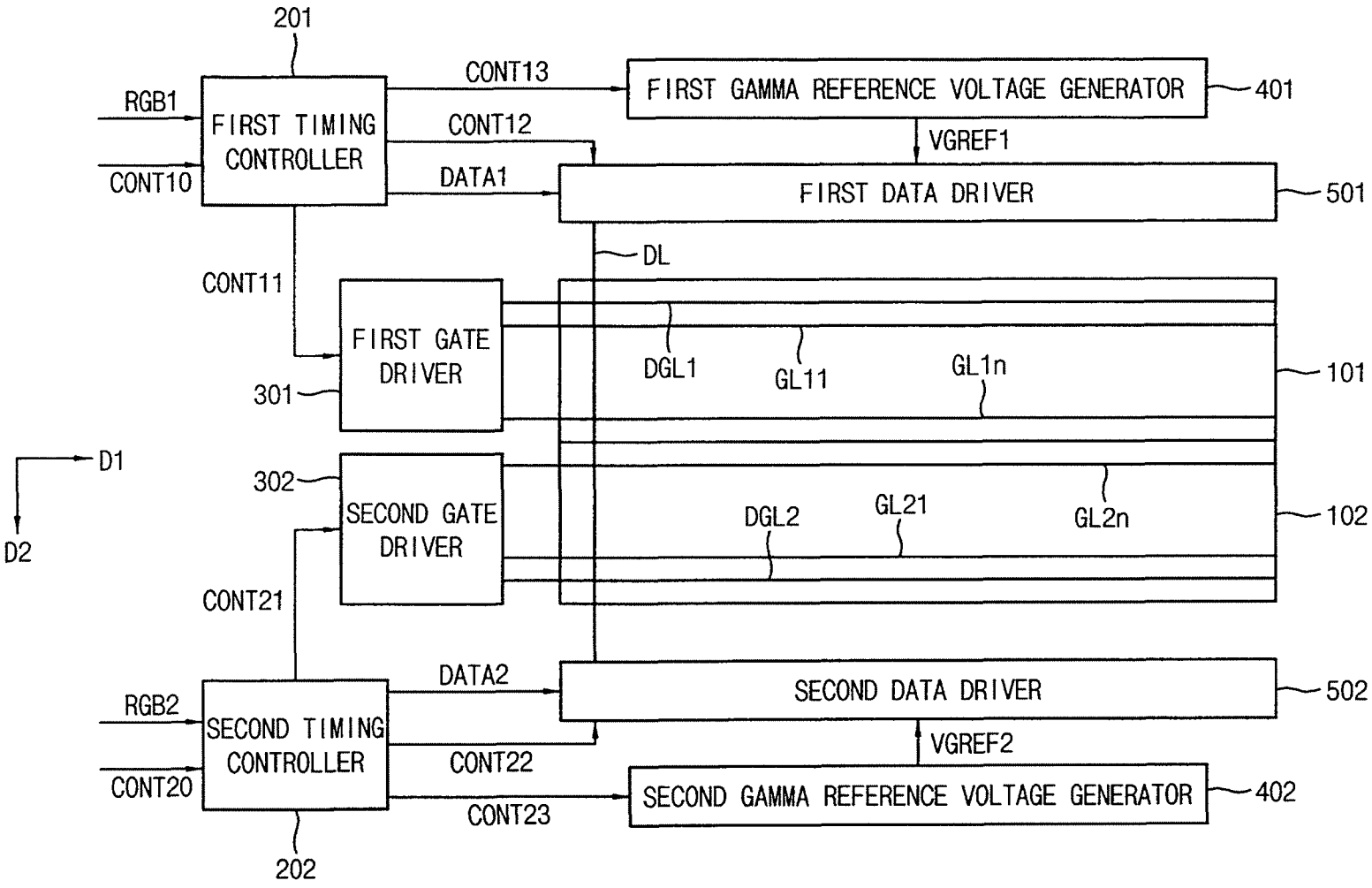
FIG. 6 is a block diagram illustrating a display apparatus according to an exemplary embodiment of the present inventive concept.

FIG. 6 is a block diagram illustrating a display apparatus according to an exemplary embodiment of the present inventive concept. Hereinafter, repetitive description thereof will be omitted.

Referring to FIG. 6, the display apparatus includes a display panel and a panel driver. The display panel is divided into a first area 101 and a second area 102. The panel driver includes a first timing controller 201, a first gate driver 301, a first gamma reference voltage generator 401, a first data driver 501, a second timing controller 202, a second gate driver 302, a second gamma reference voltage generator 402, and a second data driver 502.

The first area 101 includes a plurality of gate lines GL11~GL1*n*, a plurality of data lines DL1, a dummy gate line DGL1, a plurality of pixels each connected to one of the gate lines GL11~GL1*n* and one of the data lines DL1, and dummy capacitors connected to the dummy gate line DGL1. The gate lines GL11~GL1*n* and the dummy gate line DGL1 extend in a first direction D1 and the data lines DL1 extend in a second direction D2 crossing the first direction D1.

The dummy gate line DGL1 may be located adjacent to a first edge of the first area 101. The first edge is substantially parallel to the first gate line GL11 of the first area 101 and is the nearest edge from the first gate line GL11. In an exemplary embodiment of the present inventive concept, the dummy gate line DGL1 may be located adjacent to a second edge of the first area 101. The second edge may be opposite to the first edge. For example, the second edge may be substantially parallel to the n-th gate line GL1*n* of the first area 101 and may be the nearest edge from the n-th gate line GL1*n*.

The first gate driver 301 may scan the first area 101 in a direction from the first edge to the second edge. In an exemplary embodiment of the present inventive concept, the first gate driver 301 may scan the first area 101 in a direction from the second edge to the first edge.

The second area 102 includes a plurality of gate lines GL21~GL2*n*, a plurality of data lines DL2, a dummy gate line DGL2, a plurality of pixels each connected to one of the gate lines GL21~GL2*n* and one of the data lines DL2, and dummy capacitors connected to the dummy gate line DGL2. The gate lines GL21~GL2*n* and the dummy gate line DGL2 extend in the first direction D1 and the data lines DL1 extend in the second direction D2.

The dummy gate line DGL2 may be located adjacent to a third edge of the second area 102. The third edge is substantially parallel to the first gate line GL21 of the second area 102 and is the nearest edge from the first gate line GL21. In an exemplary embodiment of the present inventive concept, the dummy gate line DGL2 may be located adjacent to a fourth edge of the second area 102. The fourth edge may be opposite to the third edge. For example, the fourth edge may be substantially parallel to the n-th gate line GL2*n* of the second area 102 and may be the nearest edge from the n-th gate line GL2*n*.

The second gate driver 302 may scan the second area 102 in a direction from the third edge to the fourth edge. In an exemplary embodiment of the present inventive concept, the second gate driver 302 may scan the second area 102 in a direction from the fourth edge to the third edge.

A method of driving the display panel of FIG. 6 may be substantially the same as the method described with reference to FIGS. 3, 4A, 4B, 5A and/or 5B.

According to an exemplary embodiment of the present inventive concept as described above, a difference in charging rate caused by the preliminary charging may be reduced by removing blank periods between frames. For example, when a display panel is driven based on a frame inversion scheme, preliminary charging data voltages and main charging data voltages may have the same polarities as each other by using a dummy gate line connected to dummy capacitors, and thus, display quality thereof may be increased.

The foregoing is illustrative of the present inventive concept and is not to be construed as limiting thereof. Although a few exemplary embodiments thereof have been described, it will be understood that various modifications in form and detail may be made therein without materially departing from the spirit and scope of the present inventive concept as defined in the claims.

What is claimed is:

1. A method of driving a display panel comprising first through n-th gate lines and a plurality of pixels connected to each of the first through n-th gate lines, the method comprising:

sequentially applying activated gate signals to the first through n-th gate lines, respectively, during a first frame period, to display first through n-th horizontal lines of a first frame image respectively;

charging pixels connected to the n-th gate line with first data voltages corresponding to the n-th horizontal line of the first frame image during a first period that occurs during the first frame period;

charging pixels connected to the first gate line with the first data voltages during the first period;

charging the pixels connected to the first gate line with second data voltages corresponding to a first horizontal line of a second frame image during a second period subsequent to the first period, the second period occurring during a second frame period; and charging pixels connected to the second gate line with the second data voltages during the second period, wherein n is a natural number greater than or equal to 2.

2. The method of claim 1, wherein the display panel includes a first area and a second area, and a first gate driver and a first data driver are connected to the first area, and a second gate driver and a second data driver are connected to the second area.

3. A method of driving a display panel comprising first through n-th gate lines and a plurality of pixels connected to each of the first through n-th gate lines, the method comprising:

sequentially applying activated gate signals to the first through n-th gate lines, respectively, during a first frame period, to display first through n-th horizontal lines of a first frame image respectively;

charging pixels connected to the n-th gate line with first data voltages corresponding to the n-th horizontal line of the first frame image during a first period, each of the first data voltages having a first polarity;

charging dummy capacitors connected to a dummy gate line in the display panel with second data voltages during a second period subsequent to the first period, each of the second data voltages having a second polarity different from the first polarity;

charging pixels connected to the first gate line with the second data voltages during the second period; and charging the pixels connected to the first gate line with third data voltages corresponding to a first horizontal line of a second frame image during a third period subsequent to the second period, each of the third data voltages having the second polarity, the third period occurring during a second frame period, wherein n is a natural number greater than or equal to 2.

4. The method of claim 3, wherein the display panel includes a first area and a second area, and a first gate driver and a first data driver are connected to the first area, and a second gate driver and a second data driver are connected to the second area.

5. The method of claim 4, wherein the first area including a first edge and a second edge positioned at an opposite side to the first edge is driven in a direction from the first edge to the second edge, wherein the second area including a third edge and a fourth edge at an opposite side to the third edge is driven in a direction from the third edge to the fourth edge.

6. The method of claim 5, wherein the first edge of the first area and the third edge of the second area are adjacent to a center of the display panel.

7. The method of claim 3, wherein the dummy gate line is located adjacent to at least one of a first edge of the display panel or a second edge of the display panel, wherein the second edge is positioned at an opposite side to the first edge.

8. The method of claim 3, wherein a value of each of the second data voltages is substantially the same as a value of a corresponding one of the third data voltages.

9. The method of claim 3, further comprising: charging the dummy capacitors with the first data voltages during the first period.

10. A display apparatus comprising:

a display panel comprising a plurality of pixels, a plurality of dummy capacitors, a plurality of data lines, first through n-th gate lines and a dummy gate line connected to the dummy capacitors, wherein the display panel is configured to display an image;

a gate driver configured to sequentially apply activated gate signals to the first through n-th gate lines, respectively, during a first frame period, to display first through n-th horizontal lines of a first frame image respectively, configured to output an n-th gate voltage to the n-th gate line during a first period that occurs during the first frame period, configured to output a dummy gate voltage to the dummy gate line during a second period subsequent to the first period, configured to output a first charging gate voltage to the first gate line during the second period, and configured to output a first gate voltage to the first gate line during a third period subsequent to the second period, the third period occurring during a second frame period; and a data driver configured to output first data voltages corresponding to the n-th horizontal line of the first frame image to the data lines during the first period, configured to output second data voltages to the data lines during the second period, and configured to output third data voltages corresponding to first horizontal line of a second frame image to the data lines during the third period, wherein each of the first data voltages has a first polarity, each of the second data voltages has a second polarity different from the first polarity, and each of the third data voltages has the second polarity, wherein n is a natural number greater than or equal to 2.

11. The display apparatus of claim 10, wherein the display panel includes a first area and a second area, and the first area is driven separately from the second area.

12. The display apparatus of claim 11, wherein the first area including a first edge and a second edge positioned at an opposite side to the first edge is driven in a direction from the first edge to the second edge, and the second area including a third edge and a fourth edge positioned at an opposite side to the third edge is driven in a direction from the third edge to the fourth edge.

13. The display apparatus of claim 12, wherein the first edge of the first area and the third edge of the second area are adjacent to a center of the display panel.

14. The display apparatus of claim 12, wherein the dummy gate line is located adjacent to the first edge of the first area, the second edge of the first area, the third edge of the second area, or the fourth edge of the second area.

15. The display apparatus of claim 10, wherein the dummy gate line is located adjacent to at least one of a first edge of the display panel or a second edge of the display panel, wherein the second edge is positioned at an opposite side to the first edge.

16. The display apparatus of claim 10, wherein a value of each of the second data voltages is substantially the same as a value of a corresponding one of the third data voltages.

17. The display apparatus of claim 10, wherein the gate driver is configured to output a dummy gate voltage to the dummy gate line during the first period.

18. The display apparatus of claim 10, further comprising a timing controller configured to generate signals for the data driver and the gate driver.

19. A display apparatus comprising:

a display panel comprising a plurality of pixels, a plurality of data lines, and first through n-th gate lines, wherein the display panel is configured to display an image;

a gate driver configured to sequentially apply activated gate signals to the first through n-th gate lines, respectively, during a first frame period, to display first through n-th horizontal lines of a first frame image respectively, to output an (n−1)-th gate voltage to the (n−1)-th gate line during a first portion of a first period, to output a first charging gate voltage to the first gate line during the first portion of the first period, and to output a first gate voltage to the first gate line during a first portion of a second period subsequent to the first period, the first period occurring during the first frame period, the second period occurring during a second frame period; and a data driver configured to output first data voltages corresponding to the n-th horizontal line of the first frame image to the data lines during the first portion of the first period, and to output second data voltages corresponding to a first horizontal line of a second frame image to the data lines during the first portion of the second period, wherein the gate driver is configured to output an n-th gate voltage to the n-th gate line during a second portion of the first period, to output a second charging gate voltage to the second gate line during the second portion of the first period, wherein n is a natural number greater than 2.

20. The display apparatus of claim 19, wherein the gate driver is configured to output a second gate voltage to the second gate line during a second portion of the second period, wherein the data driver is configured to output third data voltages corresponding to the (n−1)-th horizontal line of the first frame image to the data lines during the second portion of the first period, and to output fourth data voltages corresponding to a second horizontal line of the second frame image to the data lines during the second portion of the second period, and wherein the second portion of the first period is subsequent to the first portion of the first period, and the second portion of the second period is subsequent to the first portion of the second period.

* * * * *